United States Patent [19]

Gerry

[11] Patent Number: 4,573,669

[45] Date of Patent: Mar. 4, 1986

[54] JAW PLATE

[75] Inventor: Kenneth L. Gerry, Riverside, Calif.

[73] Assignee: Guy T. Gerry, Akron, Ohio

[21] Appl. No.: 720,519

[22] Filed: Apr. 5, 1985

[51] Int. Cl.[4] ..... B25B 1/24

[52] U.S. Cl. ..... 269/271

[58] Field of Search ..... 269/60, 71, 73, 140, 269/152, 155, 240, 244, 250–253, 257–259, 262, 265, 271, 282, 296, 307; 51/217 R, 238 R, 238 S, 239; 308/3 R

[56] References Cited

U.S. PATENT DOCUMENTS

| | | | |
|---|---|---|---|
| 461,202 | 10/1891 | Pentz | 269/60 X |
| 617,113 | 1/1899 | Marcille | 269/242 X |
| 2,005,222 | 6/1935 | Criley | 308/3 R X |
| 2,203,162 | 6/1940 | Lee | 269/60 |
| 3,465,669 | 9/1969 | Doudet | 308/3 R |
| 3,901,127 | 8/1975 | Stone | 51/217 R |
| 4,216,950 | 8/1980 | Mason | 269/271 |

*Primary Examiner*—Frederick R. Schmidt
*Assistant Examiner*—Steven P. Schad
*Attorney, Agent, or Firm*—Georges A. Maxwell

[57] ABSTRACT

A machine vise having a first jaw with a flat, inwardly disposed inner face, a second jaw with a flat, inwardly disposed inner face, opposing the inner face of the first jaw, a jaw plate carried by each jaw and including a block-like body with a flat face in bearing engagement with the inner face of the jaw and flat, inwardly disposed work-engaging surface, fasteners securing the body on the jaw, one or both of said jaws includes a vertically adjustable steady rest comprising an elongate, work-engaging bar adjacent to and extending laterally of the work-engaging surface, an elongate vertical through opening with opposing vertical sides in the body and opening at the face and work-engaging surface, a pair of elongate vertical wedges at the sides of the opening and having inwardly convergent opposing guide surfaces, a block fixed to the bar and having inwardly convergent faces slidably engaging the wedges, a retainer for the block and the wedges and an elongate vertical jack screw rotatably carried by the body and threadedly engaged through the block.

5 Claims, 8 Drawing Figures

JAW PLATE

This invention has to do with machine vises and is particularly concerned with a novel jaw plate with an adjustable steady rest bar.

BACKGROUND OF THE INVENTION

Ordinary machine vises provided to hold and support pieces of work in predetermined position in related machine tools include elongate beds with front and rear ends and longitudinally extending rails, fixed or stationary jaws with flat vertical rearwardly disposed faces projecting upwardly from the front ends of the beds, upwardly projecting movable jaws with forwardly disposed faces rearward of the fixed jaws and having guideways engaged with the rails; and manually operable screw means carried by the beds, rearward of and engaging the movable jaws to move them longitudinally toward and away from the fixed jaws, as desired or as circumstances require.

Further, in practice, ordinary machine vises of the character referred to are provided with removable and/or replaceable jaw plates. The jaw plates are arranged in flat bearing engagement on the faces of the vise jaws and are releasably secured thereto by screw fasteners.

Machine vises of the character referred to above are widely used throughout the art of machining and are well-known to those familiar with the art to which my invention relates.

In the course of using vises of the character referred to above, the beds of the vises are arranged and supported on work tables or the like of related machine tools and items of work to be worked upon are manually arranged in desired predetermined relationship relative to the stationary jaws and the movable jaws are advanced into engagement with the items by work, by manually operating the screw means of the vises.

The above procedure of arranging and clamping an item in a vise must, as a general rule, be carried out with great care and skill since the item of work must be supported by the vise in precise, predetermined position within the working area of its related machine tool, before it is worked upon. As a result of the foregoing, the noted procedure is time-consuming and therefore extremely costly.

In practice, where a plurality of items or pieces of work are to be worked upon in and by a machine tool, the machine vise is mounted on the work table of the tool with its stationary jaw in fixed predetermined position and so that when the work pieces are arranged between the jaws, the machinist need only manually adjust the position of the work laterally and vertically relative to the fixed jaw, preparatory to advancing the movable jaw into clamped engagement with it. This modified procedure often materially reduces set up time, that is, the time required to effect positioning and clamping of a piece of work within the vise and relative to the machine tool.

When a large number of like pieces of work are to be worked upon and to further reduce the set up time, skilled machinists frequently make and arrange "steady rest" blocks and the like on the beds of the vises, between the jaws thereof, to stop and support the pieces of work in predetermined vertical position between the vise jaws, whereby they need only concern themselves with lateral positioning of the work pieces, when setting up the work.

While the last noted modified procedure and use of separate steady rest means is effective to further reduce set up time, it is only practiced when the number of pieces of work to be worked upon is sufficient to justify the time and expense that is required to make a suitable steady rest structure and/or means.

As a general rule, when the number of pieces of work is sufficient to justify the making of special steady rest means for use within machine vises, the time and expense in producing full production tooling is generally warranted and the use of a conventional machine vise is dispensed with.

Prior to the present invention, the only teaching in the prior art which provides economically feasible and practical means to simplify and reduce the time required to set up a limited number of pieces of work in a machine vise is disclosed in U.S. Pat. No. 4,216,950, issued Aug. 12, 1980, and entitled "STEADY REST". That patent discloses a common machine vise with jaw plates fixed to the vise jaws. The jaw plates carry elongate vertically shiftable bar-like work piece engaging steady rests. The steady rests have guide blocks projecting into openings in the jaw plates and are carried by vertical screws rotatably carried by the plates and extending through the blocks. Upon rotation of the screws in the plates, the steady rest bars are raised and lowered, as desired. While the foregoing structure is effective and has great utility when close tolerances need not be maintained, it is seriously deficient and of limited utility when close tolerances must be maintained. This is due to the fact that the stability afforded by the screw thread connection between the screws and steady rest bars is inherently sloppy and is such that the bars tend to rock or teeter-totter relative to the screws when minor vertical loads are applied to the end portions of the bars. Efforts to eliminate the noted shortcoming in the above noted steady rest means, by providing close tolerances in the threads has resulted in threads which cannot be effectively turned, before acceptable stability of the steady rests is achieved.

As a result of the foregoing, the practical use to which the noted patented steady rest can be put is limited.

OBJECTS AND FEATURES OF THE INVENTION

It is an object and feature of my invention to provide a novel steady rest structure and means in jaw plates for machine vises to effectively and efficiently reduce the set up time required to arrange numbers of like pieces of work in predetermined clamped relationship within and between the jaw plates.

Another object and feature of my invention is to provide structure and means of the general character referred to above which includes elongate horizontal work-engaging steady rest bars adjacent the work-engaging faces of vise jaw plates, manually operable screw means carried by the plates and engaging the bars to vary and/or adjust the vertical positioning of the bars relative to the plate and guide means between the plates and the bars to maintain the bars horizontal, whereby the steady rest bars can be easily and quickly adjusted to effectively stop and assure predetermined vertical and horizontal positioning of the bars and of work pieces arranged within and held by the plates and the bars.

It is an object and feature of my invention to provide novel vise jaw plates with steady rest bars wherein the guide means between the plates and the bars includes guide blocks on the bars with laterally spaced laterally outwardly disposed and rearwardly convergent bearing surfaces, pairs of elongate, vertically extending wedges with rearwardly convergent guide surfaces slidably engaging the bearing surfaces and supported on laterally spaced opposing surfaces on the plates; and retaining means to move the blocks forwardly and rearwardly relative to the wedges and to thereby set the blocks in close sliding fit with the wedges whereby the blocks and the related steady rest bars are freely shiftable vertically between the wedges and are maintained horizontally disposed by said wedges.

Finally, it is an object and feature of my invention to provide a structure of the character referred to above which is rugged and durable, highly effective and dependable in operation and which is both easy and economical to make and to use.

The foregoing and other objects and features of my invention will be fully understood from the following detailed description of the invention, throughout which description reference is made to the accompanying drawings.

DETAILED DESCRIPTION OF THE INVENTION

Figure 1:
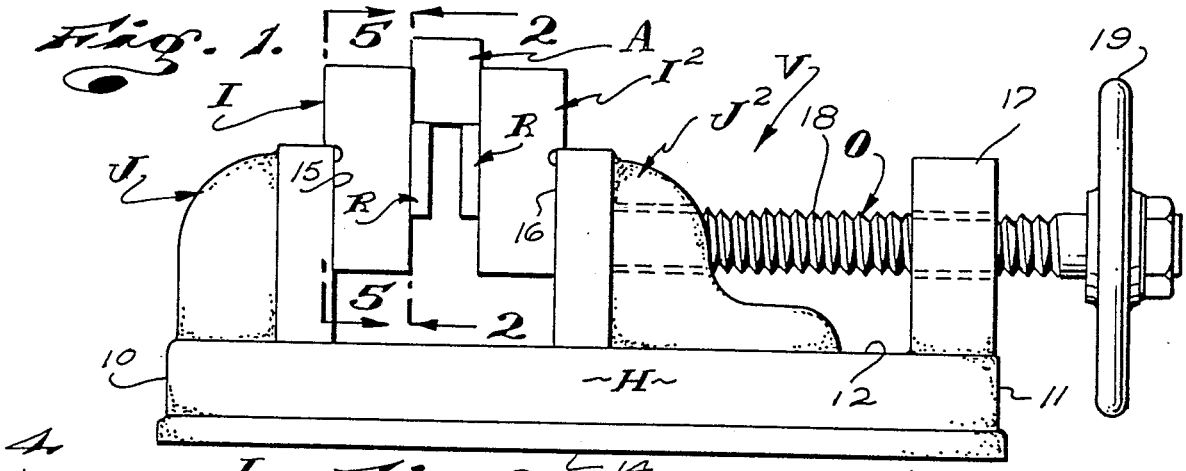
FIG. 1 is a side elevational view of a machine vise with which my invention is related.
Figure 2:
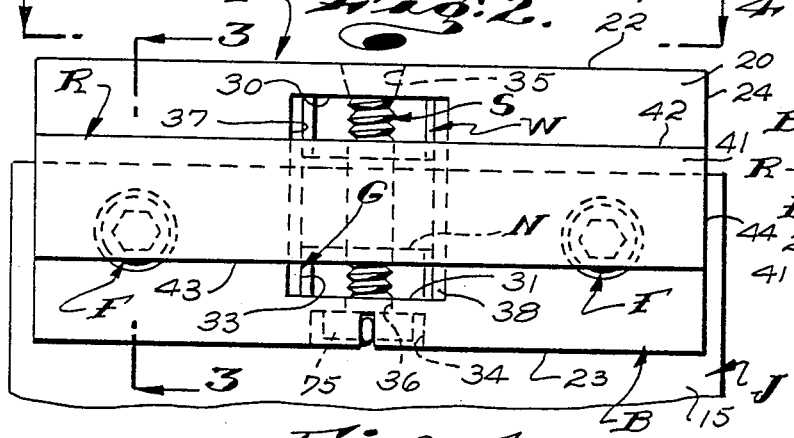
FIG. 2 is a view taken as indicated by line 2—2 on FIG. 1.
Figure 3:
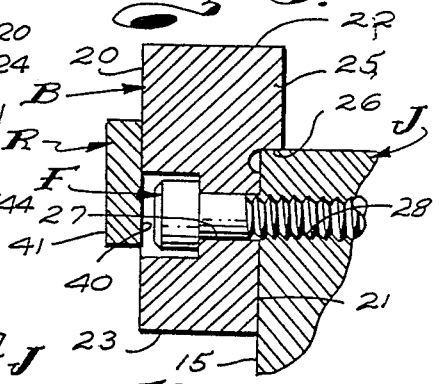
FIG. 3 is a sectional view taken as indicated by line 3—3 on FIG. 2.
Figure 4:
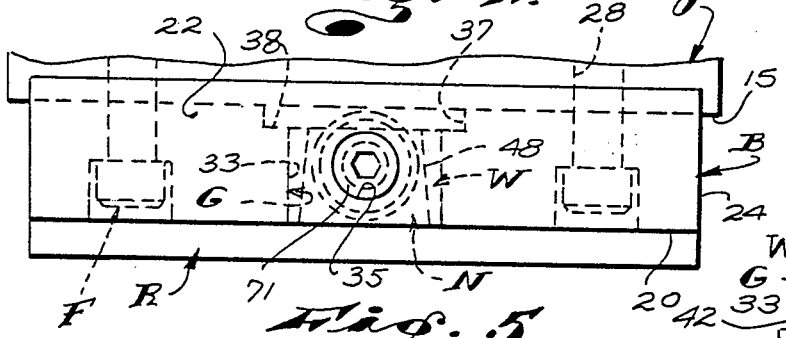
FIG. 4 is a view taken as indicated by line 4—4 on FIG. 2.
Figure 5:
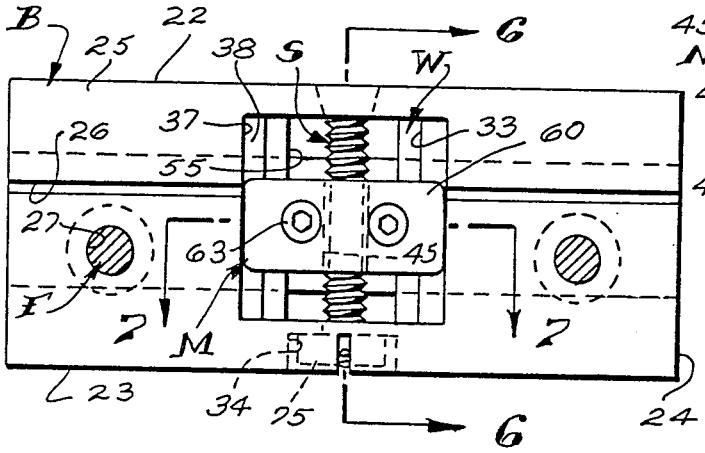
FIG. 5 is a view taken as indicated by line 5—5 on FIG. 1.

In FIG. 1 of the drawings, I have illustrated a typical or conventional machine vise V with novel jaw plates I embodying my invention related to it.

The vise V shown in the drawings is intended to illustrate the basic characteristics of common machine vises with which my novel vise jaw plates can be advantageously related. The vise V includes an elongate horizontal bed H having front and rear ends 10 and 11, a flat top 12 and a flat machine tool table engaging bottom 14. Projecting upwardly from the front portion of the bed H is a stationary or fixed front jaw J. The jaw J has a flat, vertical, transversely extending rearwardly or longitudinally inwardly disposed face 15 adapted to normally engage a piece of work A related to the vise. Projecting upwardly from the rear portion of the bed H and shiftable longitudinally relative thereto is a movable jaw $J^2$. The jaw $J^2$ has a flat, vertical, transversely extending forwardly or longitudinally inwardly disposed face 16 which is in spaced opposing relationship with the face 15 on the jaw J and which is adapted to normally engage the work piece A related to the vise and positioned adjacent the face 15.

The movable jaw $J^2$ is retained on the bed and is maintained in alignment relative thereto by appropriate guide means, such as laterally spaced, parallel, longitudinally extending rails (not shown) in the top of the bed and guideways (not shown) in the lower portion of the jaw $J^2$ and cooperatively engaged with the rails.

In practice, the jaws of machine vises of the class here concerned with are frequently two-part structures and include load supporting body parts and jaw plates screw-fastened to flat, machined, plate seating surfaces on the body parts. The plates, which define the work engaging faces of the vise jaws are such that they can be removed and replaced by new plates or by special plates, as desired, or as circumstances requires.

Finally, the vise V includes manually operable screw means O to move the rear movable jaw longitudinally of the bed and to urge that jaw into desired pressure engagement with the work piece A engaged with and stopped by the jaw J. The means O can vary widely in practice and in the case illustrated includes an upwardly projecting bearing block 17 at the rear end of the bed H, an elongate longitudinally extending screw 18 with front and rear ends, extending through and supported by the block for free rotation and against axial movement, and a manually engageable operating crank or wheel 19 secured to the rear end of the screw. The front end of the screw establishes driving engagement with the rear end of the movable jaw $J^2$. As illustrated in dotted lines in FIG. 1 of the drawings, the front end of the screw 18 is engaged and is suitably retained in a rearwardly opening socket in the jaw $J^2$.

The novel jaw plates that I provide are adapted to be releasably secured to the standard jaw plates of a related machine vise or can, if desired, replace and be used instead of the standard jaw plates on their related vise.

In the preferred carrying out and use of the present invention, two like jaw plates are provided, there being a front plate I related to the front fixed jaw J and a rear plate $I^2$ related to the rear movable jaw $J^2$, as clearly shown in FIG. 1 of the drawings.

Referring to FIGS. 2 through 7 of the drawings, the jaw plate I includes an elongate, laterally extending block-like body B with a flat, vertical longitudinally, rearwardly disposed work engaging surface 20, a flat, vertical front surface 21, flat, horizontal top and bottom surfaces 22 and 23, and flat vertical sides or ends 24.

In practice, and as shown in the drawings, the body B has a forwardly projecting enlargement 25 extending transverse its upper portion and defining a downwardly disposed orienting shoulder 26. The body B is adapted to be arranged adjacent the rear of the jaw J with its front surface 21 in flat bearing engagement with the face 15 of the jaw J and with the orienting shoulder 26 in stopped engagement with the upper forward edge of the jaw or standard jaw plate, as clearly shown in the drawings.

It will be apparent and it is to be understood that in practice, the enlargement 25 and shoulder 26 can be eliminated without departing from or adversely affecting the broader aspects of my invention.

The body B is provided with a plurality (two or more) of forwardly and rearwardly opening through openings 27 spaced vertically and laterally therein to register with rearwardly or longitudinally inwardly opening threaded fastener receiver openings 28 entering the face 15 of the jaw J and in which screw fasteners F are engaged to releasably secure the body B with the jaw J.

In the preferred carrying out of the invention, the fasteners F are cap screws and the openings 27 are provided with counter base sinks to accommodate the heads of the screws, as clearly shown in the drawings.

In addition to the foregoing, the body B is provided with an elongate vertically extending, forwardly and rearwardly opening or window G intermediate the ends of the body. The opening G has horizontal top and bottom ends 30 and 31 spaced from the top and bottom surfaces 22 and 23 of the body and flat, vertical, laterally spaced parallel opposing sides 33.

The body B next includes a downwardly opening socket 34 entering its bottom surface 23, in axial alignment with the central vertical axis of the opening or window G.

The body B includes upper and lower bearing openings 35 and 36 at the upper and lower ends of and in axial alignment with the central vertical axis of the window G.

Figure 6:
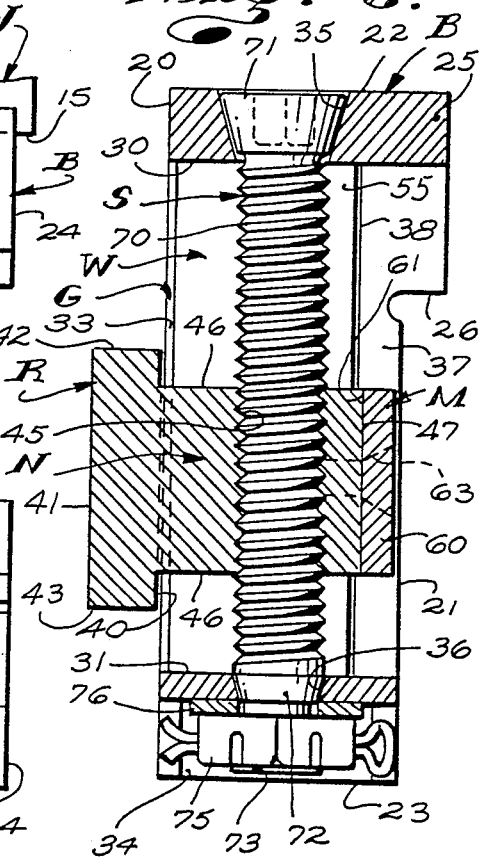
FIG. 6 is an enlarged detailed sectional view taken substantially as indicated by line 6—6 on FIG. 5.

The upper bearing opening 35 is a through opening extending between the top or upper end 30 of the window G and the top surface 22 of the body and the lower bearing opening 36 is a through opening extending between the bottom or lower end 31 of the window and the upper end or bottom of the socket 34 at the bottom 23 of the body, as clearly illustrated in FIG. 6 of the drawings.

In practice, the bearing openings are downwardly convergent tapered openings. Further, the lower opening 36 is smaller than the upper opening 35 to facilitate manufacture or establishment of the openings by means of a single tool on a single pass and to allow for convenient and effective assembly of the finished structure, as will be apparent from a study of the drawings.

In the preferred carrying out of my invention, the front surface 21 of the body B is provided with a forwardly opening recess 37 at or about the window G. The recess 37 defines a pair of flat, forwardly disposed vertically extending ways or surfaces 38 at the opposite sides of the window G.

It will be apparent from the foregoing that the body B is a rather simple, unitary part which can be easily and conveniently produced using standard machining techniques and the like.

The jaw plate I that I provide next includes an elongate horizontal steady rest bar R of limited vertical extent. The bar R is arranged adjacent the rear surface 20 of the body B and extends from one side or end thereof to the other. The bar R is a simple straight bar, rectangular in cross-section and has a flat, vertical front surface 40, a flat, vertical inwardly disposed rear surface 41, flat, horizontal top and bottom surfaces 42 and 43 and flat, vertical ends 44.

The bar R is joined or fixed to and is carried by a guide block N. The guide block N projects freely forwardly from the bar into the window G in the body B. The block N has a vertical threaded opening 45, the axis of which is concentric with the bearing openings 35 and 36 in the body B and in and through which a jack screw S, to be later described, is engaged.

In the case illustrated, the guide block N is formed integrally with the bar R by a suitable machining operation. The block N has flat, horizontal top and bottom surfaces 46, a flat vertical front surface 47 and is formed with a pair of substantially oppositely disposed, laterally spaced, flat, vertical, rearwardly convergent bearing surfaces 48. The surfaces 48 are preferably disposed at an angle of about five degrees from normal, relative to the front and rear vertical planes of the construction.

The surfaces 48 normally occur in lateral spaced relationship from their opposing related sides 33 in the window G and the front surface 47 thereof is spaced rearward from the front surface 21 of the body B to occur in a vertical plane substantially coincidental and preferably slightly rearward of the plane of the vertical ways surfaces 38 defined by the recess 37 in the body B.

Finally, the guide block N has a pair of laterally spaced forwardly opening threaded openings 49 entering its front surfaces 47.

The jaw plate construction that I provide next includes a pair of elongate, laterally spaced vertically extending wedges W arranged at opposite sides of the guide block N, between the sides 33 of the window G in the body B and the bearing surfaces 48 on the guide block. The wedges W are rectangular plate-like parts having flat, laterally outwardly disposed outside surfaces, flat, vertical front and rear edges 51 and 52, flat, horizontal top and bottom ends 53 and 54 and forwardly convergent, tapered guide surfaces 55. The wedges W are arranged in the window G of the body B with their outside surfaces 50 in flat, sliding engagement with their related sides 33 of said window and with their top and bottom ends 53 and 54 in stopped engagement with thetop and bottom surfaces of the window. The front and rear edges 53 and 54 of the wedges are spaced short distances rearward and forward of their related ways surfaces 38 and rear surfaces 20 and with their inclined or tapered guide surfaces 55 in flat sliding engagement with their opposing related bearing surfaces 48 on the guide block N.

In practice, the surfaces 33 and 50 and the surfaces 48 and 55 are machined and ground lapped whereby unfiorm flat sliding engagement is established therebetween and so that all of said surfaces are vertical and/or parallel so that the block N is slidable, vertically upwardly and downwardly, between the wedges W when all of said related surfaces in the construction are in flat uniform bearing engagement with each other.

In practice, the fit between the guide block N and the wedges W and between the wedges W and the body B is such that the rear end of the block N projects rearwardly from the rear surface 20 of the body B a limited or short distance. With such a relationship of parts, the bar R, carried by the guide block N, is supported and carried by said block in spaced running clearance relative to the rear surface 20 of the body B, as clearly shown in FIG. 7 of the drawings.

The vice jaw that I provide next includes retaining means M to maintain the bar and block unit and the wedges W in assembled position within the window G in the body B and operable to adjust and set those parts in proper and effective seated and running engagement.

The means M includes an elognate laterally extending retaining plate 60 arranged in the recess 37 in the front of the body B. The plate 60 has a flat, vertical rear surface 61 with end portions in flat sliding engagement on or with the ways or ways surfaces 38. The plate 60 has a pair of laterally spaced screw fastener openings 62 to register with the openings 49 in the guide block N.

Screw fasteners 63 are engaged through the opening 62 in the plate 60 and are rotatably carried by said plate. The screws carried by the plate are threadedly engaged in the openings 49 in the guide block N.

Finally, the plate 60 is provided with a pair of elongate, laterally spaced, vertically extending rearwardly projecting bearing beads or ridges 64. The beads 64 establish sliding bearing engagement on or with the front edges 52 of the wedges W.

The bearing beads 64 on the plate 60 urge and hold the wedges W rearward in the windows G of the body B and prevent the wedges from moving forward in the window G and relative to the plate 60.

It is to be noted that limited spaced relationship is established and maintained between the front surface 47 of the guide block N and the rear surface 61 of the plate 60.

Figure 7:
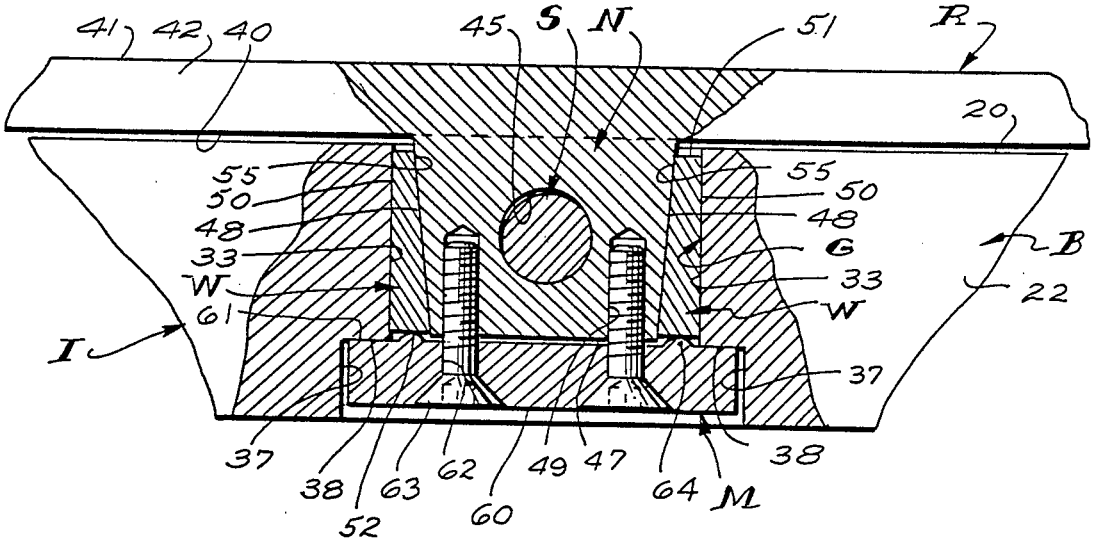
FIG. 7 is an enlarged detailed sectional view taken substantially as indicated by line 7—7 on FIG. 5.
Figure 8:
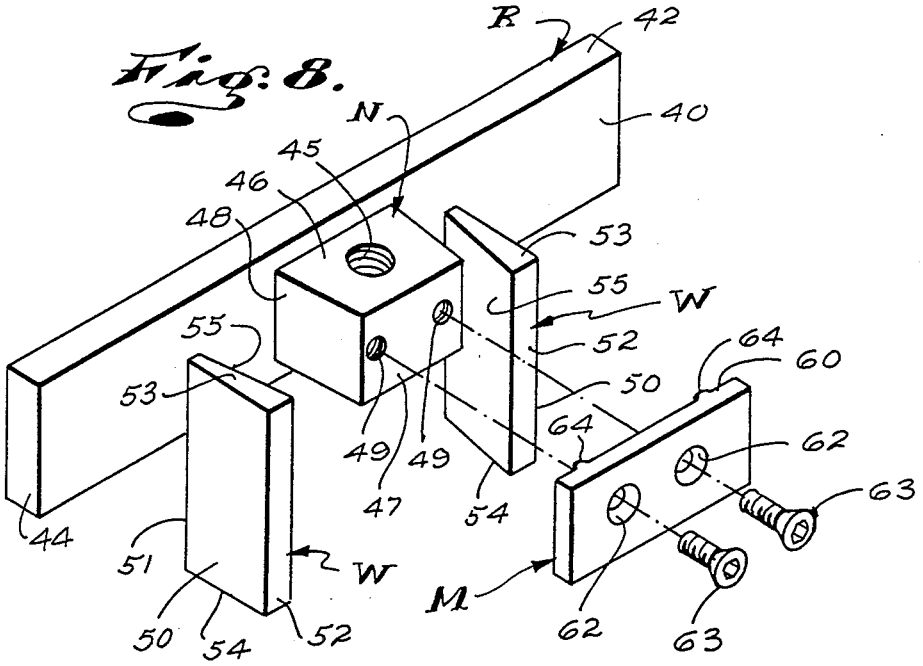
FIG. 8 is an exploded isometric view of parts of my new construction.

With the means M illustrated and described above, it will be apparent that the plate 60, the ends of which slidably engage the ways 38, hold the wedges W rearward within the window G in the body B and holds the guide block N forward in engagement with the wedges W, as clearly illustrated in FIG. 7. It will be further apparent that upon tightening or loosening the screws 63 of the means M, the guide block N can be moved forwardly or rearwardly relative to the wedges W (which wedges are stopped from lateral movement or displacement by the sides 33 of the window W) and thereby increase or decrease the pressure between the block and the wedges, whereby substantially free sliding engagement between the block N and wedges W (and the body B) without sufficient slop or working tolerances therebetween to allow for appreciable movement or shifting of the bar R from its horizontal dispoisition relative to the body B.

It is to be noted that the two laterally spaced screws 63 enable the plate 60 to be moved or adjusted forwardly and rearwardly relative to the guide block N while maintaining the forward surface of the block N and the rear surface of the plate parallel. It has been determined that a single centrally located screw instead of the two screws 63 is insufficient to maintain the above noted parallel relationship of parts and allows a misalignment of the parts which results in binding therebetween and rendering the construction inoperable.

Finally, the vise jaw that I provide includes the aforementioned jack screw S. The jack screw S includes an elongate, threaded shank 70 extending longitudinally through the window G and in threaded engagement in and through the opening 45 in the guide block N. The screw S has an enlarged downwardly convergent tapered head 71 cooperatively seated in and rotatable relative to the upper bearing opening 35 in body B; a lower downwardly tapered bearing 72 extending or continuing downward from the lower end of the shank and seated in and rotatable relative to the lower bearing opening 36 in the body; and a depending threaded stem 73, of reduced diameter, depending from the bearing 73 and projecting freely into the socket 34 in the bottom of the body B.

The head 71 has a flat top which is substantially flush with the top surface 22 of the body B. The head 71 has an upwardly opening, central, polygonal (hexagonal) turning tool receiving socket opening.

A retaining nut 75 is engaged wholly within the socket 34 in the body B and is threaded on the stem 73 of the screw S. The nut 75 is such that it can be advanced upwardly relative to the stem and the screw S to react on the bottom of the socket 34 to draw the screw S downwardly relative to the body whereby the head 71 and bearing 72 are urged into seated engagement in their related bearing openings 35 and 36. The screw S is thus set so that it is free from vertical movement relative to the body and so that sufficient frictional drag is afforded between the screw and the body to prevent the screw from freely rotating relative to the body during normal anticipated use of the construction.

In practice, a thrust washer 76 is provided about the stem 73 of the screw S, between the nut 75 and the opposing bottom of the socket 34.

In the preferred carrying out of the invention and in accordance with common practice, the nut 75 is a slotted nut and is releasably held in fixed rotative position on the stem of the screw S by means of a cotter pin engaged in and through a slot provided in the stem and registering slots in the nut.

It is to be noted that the tolerances or fit of the screw S in the opening 45 in the guide block N need not be close and is preferably sufficiently free to allow for limited forward and rearward movement and adjustment of the block N in the body and relative to the screw S, without binding between the screw and the block. The screw S does not and is not intended to guide the block N but simply functions to move the block and its related bar R up and down within the construction, as desired or as circumstances require.

With the jaw plate I described above, it will be apparent that the steady rest bar R can be moved vertically relative to and across the rearwardly disposed face 20 of the body B by engaging by Allen wrench or the like in the socket opening in the screw S and rotating that screw. By following such procedure, the bar can be moved and set in any desired vertical position relative to the body within the wide range of movement afforded by the construction.

In practice, while it is generally preferred that both the front and the rear jaw plates I and $I^2$ on the jaws J and $J^2$ of the related vise V be alike and that each include the steady rest means noted above, it is possible and in some circumstances it may be preferred that the steady rest means be eliminated or be removed from one of the plates.

In use, when the vise V with the novel jaw plates I and $I^2$ related to it is to be used to sequentially engage and hold a series of like work pieces, the first work piece can be arranged and suitably gripped by and between the opposing faces of the jaw plate in desired lateral and vertical position. Thereafter, the steady rest bars are moved up and into stopped engagement with the piece of work and the work to be performed thereon is completed. After the first piece of work has been worked upon and is released by and removed from the vise, each successive piece of work related to the vise may be first freely arranged between the jaw plates and in vertical stopped relationship with the steady rest bars. Thereafter, the machinist need only manually adjust and/or position the work laterally in the vise before operating the vise to grip the work piece.

The structure that I provide is particularly effective and economical to use when a limited number of like pieces of work are to be worked upon and the number of pieces is so limited as not to justify the time and expense that would be incurred to provide special production of tooling to hold the pieces of work.

It is to be particularly noted that the axially spaced tapered bearing openings 35 and 36 are operated with the tapered head 71 and bearing 72 of the screw S to afford zero lost motion between the screw and the body and the wedges W and block N operate to afford zero lost motion between the block N (and bar R) and the body B. The capability of the construction to establish zero lost motion, as noted above, is that which makes it sufficiently accurate to be of utility in those circumstances in which it is to be used.

Having described only one typical preferred form and application of my invention, I do not wish to be limited to the specific details herein set forth, but wish to reserve to myself any modification and/or variations that may appear to those skilled in the art and which fall within the scope of the following claims.

Having described my invention, I claim:

1. A machine vise including an elongate bed with opposite sides and ends, longitudinally spaced jaws projecting upwardly from the bed and having longitudinally inwardly disposed opposing faces, operating means between the bed and one jaw to move that jaw longitudinally of the bed and relative to the other jaw, a jaw plate carried by one jaw and including an elongate laterally extending block-like body with an outer face in bearing engagement with the inner face of the jaw and a flat, vertical, inwardly disposed work-engaging surface, releasable fastener means securing the body on the jaw, said jaw plate includes vertically adjustable steady rest means comprising an elongate laterally extending work-engaging bar adjacent and shiftable vertically relative to said work-engaging surface, an elongate vertical through opening with flat, vertical, laterally spaced opposing sides in the body substantially intermediate the ends thereof, a pair of laterally spaced vertical plate-like wedges with flat outside surfaces slidably engaged with and supported by the sides of the opening and flat, laterally spaced opposing longitudinally outwardly convergent guide surfaces, a guide block on and projecting outwardly from the bar into said opening and having flat, laterally oppositely disposed longitudinally outwardly convergent bearing surfaces slidably engaged with said guide surfaces, a retaining plate fastened to the guide block and engaging the wedges and the body at the outer surface thereof and retaining the body, wedges and block assembled; and an elongate, vertical jack screw carried by the body for free rotation and against axial movement and threadedly engaged through said block.

2. The machine vise set forth in claim 1 wherein said retaining means includes a recess at the outer surface of the body extending laterally outward from the opposite sides of said opening, said retaining plate extends laterally of and is shiftable vertically in said recess and screw fasteners engaged with and between the plate and the block hold the plate longitudinally inward in said recess and the block longitudinally outward in the opening with the wedges in stopped engagement with the sides of said opening and the opposing guide and bearing surfaces in free sliding engagement.

3. The machine vise set forth in claim 2 wherein the body has vertical spaced aligned upper and lower bearing openings tapered radially inwardly and longitudinally in the same direction and opening at the upper and lower ends of said through openings in the body, said jack screw has an elongate threaded shank portion extending longitudinally through the through opening, a tapered head at one end of the shank cooperatively seated in one bearing opening and a tapered bearing at the other end of the shank cooperatively seated in the other bearing opening, turning tool engaging means in the head and retaining means normally holding the jack screw with its head and bearing in predetermined pressure seated engagement in the bearing openings.

4. The machine vise set forth in claim 1 wherein the other jaw is provided with and carries a jaw plate similar to the jaw plate on said one jaw.

5. The machine vise set forth in claim 1 wherein said retaining means includes a recess at the outer surface of the body extending laterally outward from the opposite sides of said opening, said retaining plate extends laterally of and is shiftable vertically in said recess and screw fasteners engaged with and between the plate and the block holding the plate longitudinally inward in said recess and the block longitudinally outward in the opening with the wedges in stopped engagement with the sides of said opening and the opposing guide and bearing surfaces in free sliding engagement said screw fasteners include a pair of laterally spaced screw fasteners rotatably carried by the plate and engaged in laterally spaced outwardly opening threaded openings in said block, said plate is spaced outward from said block.

* * * * *